US007878238B2

(12) United States Patent
Potter

(10) Patent No.: US 7,878,238 B2
(45) Date of Patent: Feb. 1, 2011

(54) CLEANING APPARATUS

(75) Inventor: Ronald Potter, Aboyne (GB)

(73) Assignee: Rotary Drilling Supplies Europe Limited, Ross-shire (GB)

( * ) Notice: Subject to any disclaimer, the term of this patent is extended or adjusted under 35 U.S.C. 154(b) by 0 days.

(21) Appl. No.: 12/074,738

(22) Filed: Mar. 6, 2008

(65) Prior Publication Data

US 2008/0245523 A1 Oct. 9, 2008

(30) Foreign Application Priority Data

Mar. 7, 2007 (GB) ..... 0704382.1

(51) Int. Cl.
*E21B 37/00* (2006.01)

(52) U.S. Cl. ..... 166/173; 166/170; 166/172; 166/311

(58) Field of Classification Search ..... 166/170, 166/172, 173, 311
See application file for complete search history.

(56) References Cited

U.S. PATENT DOCUMENTS

| | | | | |
|---|---|---|---|---|
| 1,820,391 A | | 8/1931 | Hartman | |
| 2,215,514 A | | 9/1940 | MacGregor | |
| 2,628,682 A | | 2/1953 | Wright | |
| 2,867,280 A | * | 1/1959 | De Jarnett | 166/173 |
| 3,176,772 A | | 4/1965 | MacGregor | |
| 4,456,064 A | * | 6/1984 | Ford | 166/173 |
| 5,711,046 A | | 1/1998 | Potter | |

FOREIGN PATENT DOCUMENTS

| | | |
|---|---|---|
| GB | 2334541 | 8/1999 |
| GB | 2411919 | 9/2005 |
| GB | 2429723 | 3/2007 |

* cited by examiner

*Primary Examiner*—Daniel P Stephenson
*Assistant Examiner*—Yong-Suk Ro
(74) *Attorney, Agent, or Firm*—Drinker Biddle & Reath LLP

(57) ABSTRACT

A cleaning apparatus for cleaning the inner surface of an oil or gas production tubing is disclosed. The cleaning apparatus includes a tubular body, one or more cleaning elements mounted on the outer surface of the body and an elastically deformable stabiliser. The elastically deformable stabiliser is rotatably mounted on the body to centralise the apparatus in the tubing whilst also allowing the body to pass though areas of reduced diameter in the production tubing. Preferably, there are a pair of spaced apart stabilisers having a web arrangement of spars with a flange at each end.

17 Claims, 3 Drawing Sheets

CLEANING APPARATUS

FIELD OF INVENTION

This invention relates to an apparatus for use in a downhole environment, and more particularly to a cleaning apparatus particularly for use in a down hole environment and more particularly to an apparatus for use in cleaning the inner surface of production tubing.

BACKGROUND TO THE INVENTION

Well fluids including oil, gas, water and mud carry debris within the flow which gets deposited on the inner wall of a pipe or riser through which the fluid is flowing. The surface of the pipe or riser must be cleaned regularly in order to avoid these deposits from building up to a point where the drilling operation is affected.

A known well cleaning apparatus is described in U.S. Pat. No. 5,711,046 in which a tubular body is adapted for insertion into a well bore. The body has a plurality of cleaning pads mounted thereon. The cleaning pads have bristles on the outer surface thereof although scraper blades are also well known in the field. The cleaning pads are retained in position on the body by a collar which overlies a part of the cleaning pad.

As the body passes through a well tubular, the bristles or scraper blades contact the inner surface of the tubular and remove debris and deposits from the wall of the tubular thereby cleaning the inner surface.

Such a cleaning apparatus as described is useful in providing a cleaning operation where the inner diameter of the well tubular to be cleaned is constant. However, production tubing of a well is formed of a large number of tubulars connected together in a vertical string.

The end of each tubular is provided with an area of thickened diameter such as to produce a nipple on the annular tubular. When the tubulars are connected in the string, the inner bore of the resulting production tubing has interruptions which correspond in position to the nipples at the riser joints.

The cleaning apparatus as described above is unable to pass through the reduced diameter around the joints between a first riser and the subsequent riser in the string as the outer diameter of the body cannot be reduced by the appropriate amounts.

SUMMARY OF THE INVENTION

According to one aspect of the present invention there is provided a cleaning apparatus for cleaning the inner surface of production tubing, the apparatus comprising a tubular body, a cleaning element mounted on the outer surface of the body and an elastically deformable stabiliser rotatably mounted on the body to allow the body to pass though areas of reduced diameter in the production tubing.

Preferably the stabiliser comprises a substantially cylindrical body having upper and lower substantially annular flanges and at least one resilient spar extending between the flanges.

The stabiliser can elastically deform between the rest position in which no radial force is applied to the spar and the outer diameter of the stabiliser is greater than the outer diameter of the flanges, and a reduced diameter dynamic position in which a radial force is applied to the spar, for example by an interruption in the inner surface of a production tubing such as by a temporary reduction in the diameter of the inner surface of at least a portion of the production tubing.

Preferably a bushing is provided between the stabiliser and the body of the cleaning apparatus such that the cleaning apparatus can rotate with respect to the stabiliser.

Preferably a web of spars is provided between the upper and lower flanges.

Advantageously, the spars are evenly spaced around the web.

Preferably, the stabiliser is formed of spring steel.

Preferably the stabiliser is heat treated to strengthen the stabiliser.

Preferably the stabiliser is annealed.

Advantageously, the stabiliser is machined from a tubular body.

Preferably, the distance between the upper and lower substantially annular flanges of the stabiliser is variable depending upon whether the stabiliser is in the rest configuration in which case the said distance is relatively short or the reduced diameter dynamic configuration in which case the said distance is relatively long.

Typically, the bushing is located within a pair of retaining members spaced apart by a distance substantially equal to the length of the bushing.

Preferably, the distance between the pair of retaining members is substantially equal to the relatively long distance between the upper and lower substantially annular flanges of the stabiliser when in the reduced diameter dynamic configuration and the distance between the pair of retaining members is greater than the relatively short distance between the upper and lower substantially annular flanges of the stabiliser when in the rest configuration.

Preferably, the radial extent of the said pair of retaining members at their widest diameter is substantially equal to the radial extent of the stabiliser when in the reduced diameter dynamic configuration.

Preferably, the cleaning apparatus comprises a pair of said stabilisers forming an upper and a lower stabiliser axially spaced apart along the longitudinal axis of the cleaning apparatus.

Typically, the cleaning element comprises an upper and a lower cleaning assembly.

Typically, each of the upper and lower cleaning assemblies comprise a plurality of cleaning members substantially equispaced around the circumference of the body.

Typically, each of the cleaning members is located within a respective recess in the body and ends of each of the cleaning members are retained within the respective recess by a respective fixed retaining collar ring.

Most preferably, the upper stabiliser is located above the upper cleaning assembly and the lower stabiliser is located below the lower cleaning assembly.

Preferably the cleaning pad is provided with a plurality of bristles for cleaning the inner surface of the production tubing.

Alternatively the cleaning pad is provided with a plurality of scraper blades for cleaning the inner surface of the production tubing.

The cleaning apparatus is particularly suited for cleaning the inner surface of downhole oil & gas production tubing but it could also be used in some other tubular throughbore cleaning applications where the challenges are similar.

BRIEF DESCRIPTION OF THE DRAWINGS

An embodiment of the present invention will now be described with reference to and as shown in the accompany drawings in which.

DETAILED DESCRIPTION OF PREFERRED EMBODIMENTS

Figure 1:
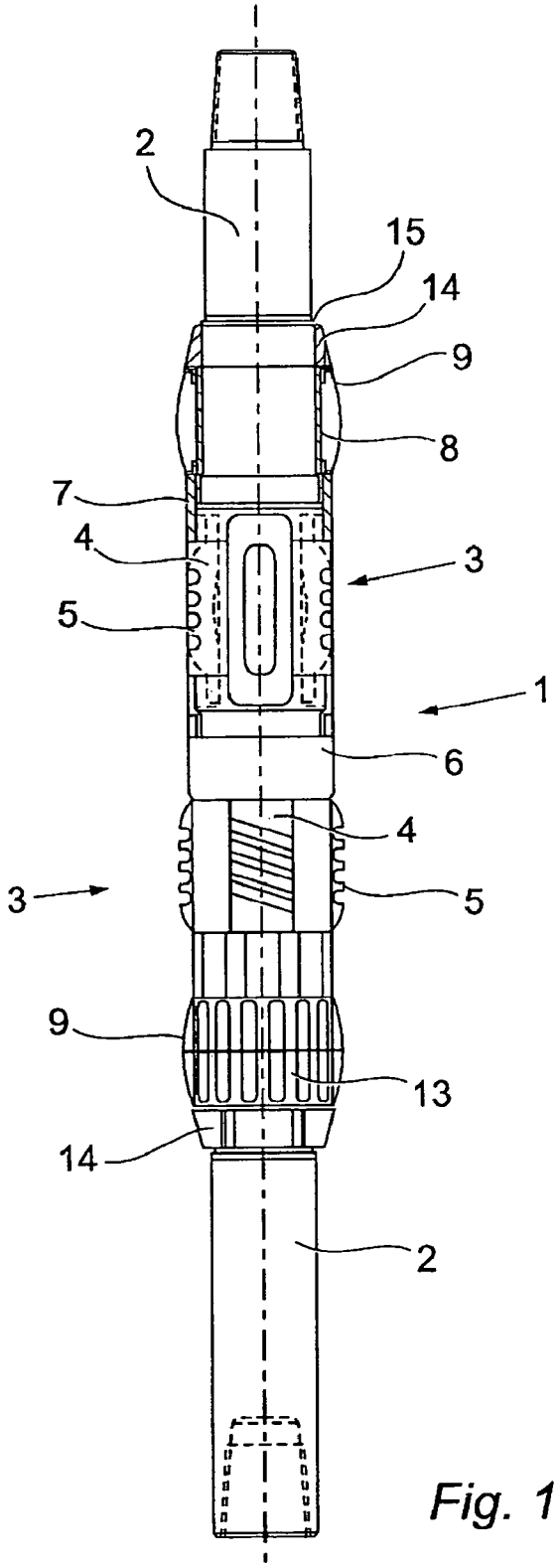
FIG. 1 is a schematic view of a cleaning apparatus according to one embodiment of the present invention.
Figure 2:
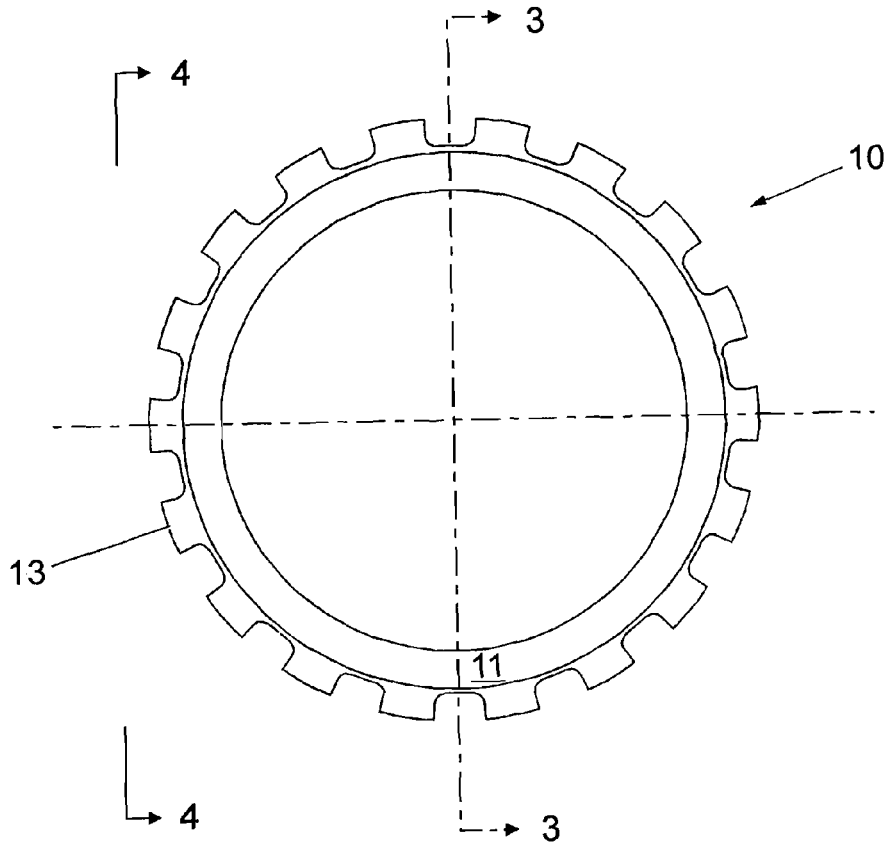
FIG. 2 is a schematic end view of a stabiliser of the cleaning apparatus of FIG. 1.
Figure 3:
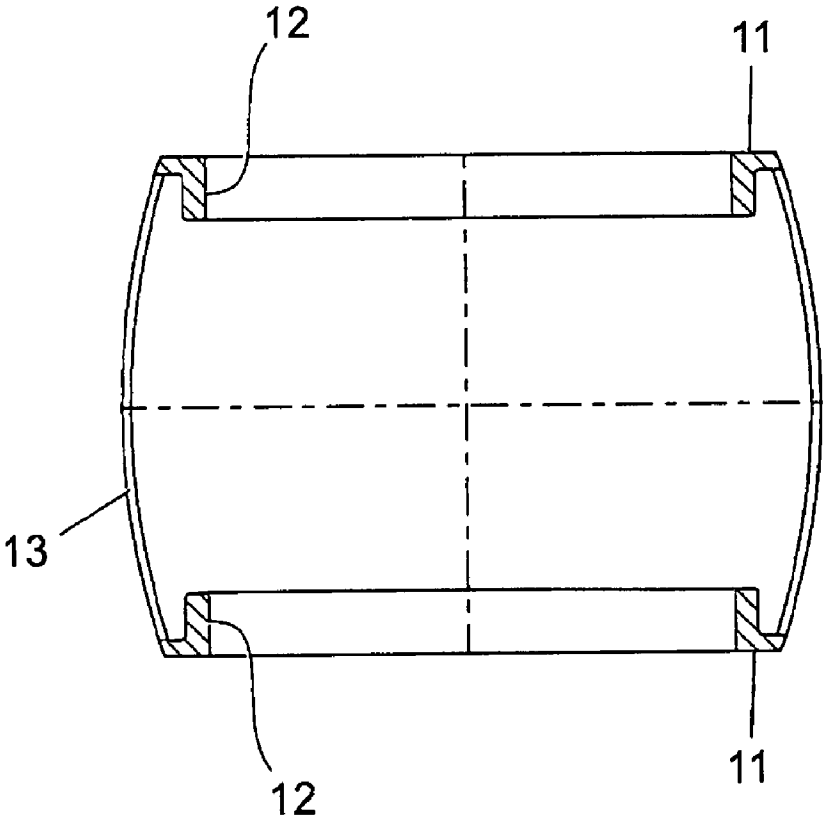
FIG. 3 is a cross-sectional view on the line 3-3 of FIG. 2.
Figure 4:
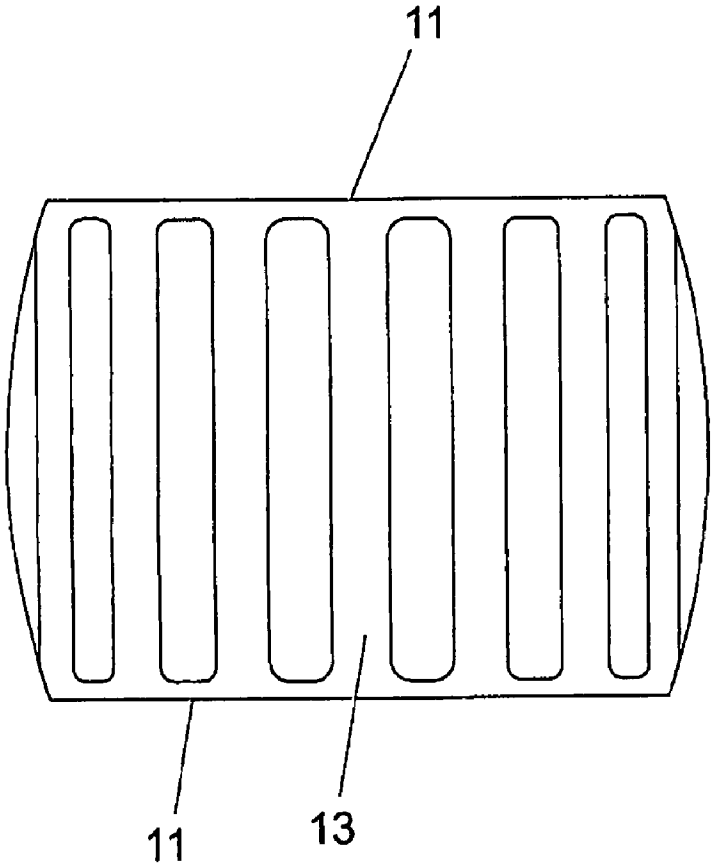
FIG. 4 is a side view on the line 4-4 of FIG. 2.

Turning now to the Figures, there is shown in FIG. 1 a cleaning apparatus 1 according to one aspect of the present invention.

The cleaning apparatus comprises a tubular mandrel 2 which is adapted for lowering into a production tubing in a well bore. A typical inner diameter for production tubing is 2⅞$^{th}$ inch or 3½ inch. The embodiment described below is adapted for use in production tubing having a 2⅞$^{th}$ inch inner diameter.

In the embodiment shown, two cleaning assemblies 3 carrying scraper blocks 4 are mounted on the mandrel 2. The scraper blocks may be manufactured from hardened steel or any other suitable material. Each scraper block 4 has a plurality of scraper blades 5 formed thereon. The scraper blades extend outwardly from the mandrel and may be of a known type.

The cleaning assemblies 3 are spring loaded via springs (now shown) which act to bias the cleaning assemblies outwardly from the mandrel such that the walls of the production tubing are contacted by the scraper blades 5 but allow the cleaning assemblies 3 to retract towards the mandrel of the apparatus against the spring force. The upper and lower faces of the cleaning assemblies may be chamfered to allow for a smooth passage of the apparatus through the production tubing.

In the embodiment shown, four scraper blocks 4 are mounted in a respective recess in each cleaning assembly and are equi-spaced around the circumference.

The two cleaning assemblies 3 are spaced apart on the mandrel 2 of the cleaning apparatus through an annular collar 6. The cleaning assemblies 3 may be centred on the mandrel or may alternatively be mounted closer to one end of the mandrel than the other.

A retaining ring 7 is mounted on either end of the mandrel 2, at the end of each cleaning assembly 3 remote from the collar 6.

A bushing 8 which may be an elongate brass collar which fits tightly to the outer surface of the mandrel is mounted on each end of the mandrel adjacent the retaining rings 7.

A stabiliser 9 is mounted on the mandrel 2 over each bushing 8 such that the mandrel of the cleaning apparatus can rotate with respect to the stabilisers 9.

Each stabiliser 9 comprises a substantially tubular body 10 formed of spring steel. The upper and lower ends of the stabilisers are provided with a substantially horizontal annular flange 11. Each flange has a rim 12 which extends into the body 10 of the stabilisers substantially perpendicularly to the flanges 11. The inner diameter of the flanges in the embodiment shown is about 2.188 inch and the outer diameter is about 2.562 inch The upper and lower flanges 11 are spanned by a web of spars 13 which in the embodiment shown are integral with the flanges. The spars are substantially rectangular in shape and in the embodiment shown are equi-spaced around the stabiliser 9.

In this embodiment, the spaces between the spars 13 are about 1.875 inch in length and about 0.25 inch in width.

The spars of the stabiliser bow outwards between the flanges 11 such that the outer diameter of the stabiliser 9 at the widest part is about 2.874 inch.

A locking ring 14 is provided on the mandrel 2 behind the bushing 8 to retain the stabiliser 9 in position upon the bushing. The leading end of the locking ring may have an internal thread (not shown) to allow the locking ring 14 to be tightened upon an external thread (not shown) provided on the outer surface of the mandrel 2. A sealing ring 15 such as an o-ring may be mounted behind the locking ring 14 to retain the locking ring in position.

On assembly of the cleaning apparatus 1, the locking rings 14 are mounted adjacent the stabilisers 9 at a position which allows for an increase in the length of the stabilisers during elastic deformation as will be described further below.

As the cleaning apparatus 1 is inserted into production tubing, the cleaning assemblies 3 operate in a known manner to scrape the inner surface of the production tubing thereby removing debris from the inner surface to prevent fouling of equipment in the tubing.

The outer diameter of the stabilisers 9 is selected to closely match the diameter of the production tubing to ensure that the stabilisers maintain the cleaning apparatus 1 centrally within the production tubing particularly when used in wells with high angles or in horizontal wells.

Whilst the stabilisers 9 do not rotate within the production tubing, by mounting the stabilisers 9 on a bushing 8, this allows the mandrel 2 of the cleaning assembly to rotate with respect to the stabilisers 9. This allows the entire surface of the production tubing to be scraped by one or other of the scraper blocks 4 as the mandrel rotates. The cleaning apparatus is also subjected to reduced torq and vibrational forces. Therefore less energy is required to control the cleaning apparatus 1 during the cleaning operation than with known cleaning tools.

Additionally as the mandrel 2 of the cleaning apparatus rotates with respect to the stabilisers 9 rather than the stabilisers rotating within the production tubing, this reduces wear on the inner surface of the production tubing.

When the cleaning apparatus 1 encounters an interruption in the inner surface of the production tubing, such as passing through a nipple between two adjacent risers in the production string where the inner diameter of the production tubing is reduced, the stabilisers 9 elastically deform from the rest position in which the spars 13 bow outwardly between the upper and lower flanges 11, to the dynamic position in which the outer diameter of the stabilisers 9 reduces as required to allow the stabilisers and the cleaning apparatus to pass the restriction.

The outer diameter of the stabilisers 9 may reduce to the outer diameter of the flanges 11 of the stabilisers if required. The overall length of the stabilisers 9 increases slightly to accommodate the elastic deformation and the spacing between the stabilisers 9 and the locking rings 14 accommodates this increase in length. Furthermore, and if required, the outer diameter of the stabiliser 9 can be compressed substantially flat such that is of substantially equal diameter to the rest of the cleaning apparatus 1 outer diameter at which point the length of the stabilisers 9 will substantially equal the distance between the retaining ring 7 and the respective locking ring 14.

In the embodiment described, the outer diameter of the stabilisers 9 reduces from 2⅞ inch to 2$^{9}/_{16}$ inch thereby allowing the cleaning apparatus 1 to pass the restriction and on into the next adjacent piece of production tubing. As each stabiliser 9 clears the restriction, the spars 13 elastically return to their rest position.

In the embodiment described above, the cleaning apparatus 1 is adapted for use in production tubing having a 2⅞ inch diameter. Where the cleaning apparatus is to be used within production tubing of different diameters, such as 3½ inch diameter tubing, the dimensions of the stabilisers 9 will be altered as appropriate to retain the same operational effects as described.

In the embodiment described above, scraper blocks 4 are mounted to the cleaning assemblies 3. However, it is envisaged that the scraper blocks 4 may be changed for bristle blocks (not shown). In this case, the bristle blocks may be manufactured from steel or materials as required. The bristles themselves may be manufactured from spring steel, phosphor, bronze or nylon and may be provided in a configuration which allows debris to pass between the bristles with circulating fluid.

It is to be understood that any number of cleaning assemblies 3 and cleaning blocks 4 may be provided on the mandrel of the cleaning apparatus. Furthermore, the number of stabilisers provided on the apparatus may be altered to fit the specific requirements of the cleaning apparatus. A single stabiliser may be provided in some applications.

Modifications and improvements may be made to the embodiments hereinbefore described without departing from the scope of the invention.

I claim:

1. A cleaning apparatus for cleaning the inner surface of production tubing, the apparatus comprising:— a tubular body;

a cleaning element mounted on the outer surface of the body; and an elastically deformable stabiliser rotatably mounted on the body to allow the body to pass through areas of reduced diameter in the production tubing;

wherein the outer diameter of the stabiliser is adapted to closely match the inner surface of the production tubing and wherein the stabiliser is further adapted not to rotate within the production tubing; and wherein a bushing is provided between the stabiliser and the tubular body such that the tubular body freely rotates within the stabiliser without longitudinal movement of the tubular body relative to the stabiliser when the inner surface of the production tubing is cleaned by the cleaning elements by rotation of the tubular body.

2. A cleaning apparatus according to claim 1, wherein the stabiliser comprises a substantially cylindrical body having upper and lower substantially annular flanges and at least one resilient spar extending between the flanges.

3. A cleaning apparatus according to claim 2, wherein the stabiliser is adapted to elastically deform between a rest configuration in which no radial force is applied to the spar and the outer diameter of the stabiliser is greater than the outer diameter of the flanges, and a reduced diameter dynamic configuration in which a radial force is applied to the spar by a reduction in the diameter of the inner surface of at least a portion of the production tubing.

4. A cleaning apparatus according to claim 3, wherein the distance between the upper and lower substantially annular flanges of the stabiliser is variable depending upon whether the stabiliser is in the rest configuration in which case the said distance is relatively short or the reduced diameter dynamic configuration in which case the said distance is relatively long.

5. A cleaning apparatus according to claim 2, wherein a web of spars is provided between the upper and lower flanges.

6. A cleaning apparatus according to claim 5, wherein the spars are substantially equi-spaced around the circumference of the web.

7. A cleaning apparatus according to claim 6, wherein a bushing is provided between the stabiliser and the body of the cleaning apparatus such that the cleaning apparatus can rotate with respect to the stabiliser.

8. A cleaning apparatus according to claim 1, wherein the bushing is located within a pair of retaining members spaced apart by a distance substantially equal to the length of the bushing.

9. A cleaning apparatus according to claim 8, wherein:— the distance between the upper and lower substantially annular flanges of the stabiliser is variable depending upon whether the stabiliser is in the rest configuration in which case the said distance is relatively short or the reduced diameter dynamic configuration in which case the said distance is relatively long; and the distance between the pair of retaining members is substantially equal to the relatively long distance between the upper and lower substantially annular flanges of the stabiliser when in the reduced diameter dynamic configuration and the distance between the pair of retaining members is greater than the relatively short distance between the upper and lower substantially annular flanges of the stabiliser when in the rest configuration.

10. A cleaning apparatus according to claim 8, wherein the radial extent of the said pair of retaining members at their widest diameter is substantially equal to the radial extent of the stabiliser when in the reduced diameter dynamic configuration.

11. A cleaning apparatus according to claim 1, further comprising a pair of said stabilisers forming an upper and a lower stabiliser axially spaced apart along the longitudinal axis of the cleaning apparatus.

12. A cleaning apparatus according to claim 11, wherein the cleaning element comprises an upper and a lower cleaning assembly and the upper stabiliser is located above the upper cleaning assembly and the lower stabiliser is located below the lower cleaning assembly.

13. A cleaning apparatus according to claim 1, wherein the cleaning element comprises an upper and a lower cleaning assembly.

14. A cleaning apparatus according to claim 13, wherein each of the upper and lower cleaning assemblies comprise a plurality of cleaning members substantially equi-spaced around the circumference of the body.

15. A cleaning apparatus according to claim 14, wherein each of the cleaning members is located within a respective recess in the body and ends of each of the cleaning members are retained within the respective recess by a respective fixed retaining collar ring.

16. A cleaning apparatus according to claim 1, wherein the cleaning member is provided with a plurality of bristles for cleaning the inner surface of the production tubing.

17. A cleaning apparatus according to claim 1, wherein the cleaning member is provided with a plurality of scraper blades for cleaning the inner surface of the production tubing.

* * * * *